United States Patent [19]

Schultz et al.

[11] 4,406,421

[45] Sep. 27, 1983

[54] PAPER TOWEL DISPENSER WITH RACK AND GEAR DRIVE

[75] Inventors: Arthur N. Schultz; James A. Diring; Donald G. Krueger, all of Green Bay, Wis.

[73] Assignee: Alwin Manufacturing Company, Inc., Green Bay, Wis.

[21] Appl. No.: 320,243

[22] Filed: Nov. 12, 1981

[51] Int. Cl.[3] ..... B65H 19/00; B65H 17/26

[52] U.S. Cl. ..... 242/55.53; 226/129

[58] Field of Search ..... 242/55.3, 55.53; 312/38, 39; 225/192; 226/127-130, 132

[56] References Cited

U.S. PATENT DOCUMENTS

| | | | |
|---|---|---|---|
| 3,459,353 | 8/1969 | Taylor | 226/132 |
| 3,672,552 | 6/1972 | Krueger et al. | 226/129 |
| 3,797,769 | 11/1973 | Tucker | 242/55.53 |
| 4,192,442 | 3/1980 | Bastian et al. | 226/127 |
| 4,260,117 | 4/1981 | Perrin et al. | 242/55.3 |

*Primary Examiner*—Leonard D. Christian

*Attorney, Agent, or Firm*—Henry C. Fuller

[57] ABSTRACT

A paper towel dispenser employs a rack and gear drive actuated by a lever to rotate a feed roll to dispense the web. The gear rack is slideably supported on the inside of the dispenser cover and has a lever extending through an opening in the cover. The gear rack meshes with a gear train supported within the cabinet interior when the cover is closed.

6 Claims, 5 Drawing Figures

PAPER TOWEL DISPENSER WITH RACK AND GEAR DRIVE

BACKGROUND OF THE INVENTION

The invention relates to roll towel dispensers with feed levers which extend through the dispenser cover and in which the lever operates a drive mechanism to rotate a feed roller to feed the web through a dispensing outlet. Dispensers of this type are found in U.S. Pat. No. 3,797,769; U.S. Pat. No. 3,672,552; and U.S. Pat. No. 4,260,117. The last two patents involve the use of a driving arrangement employing a gear segment or gear rack which is connected to the actuating lever and which drives a pinion gear to translate the reciprocating lever motion into rotary motion of the feed roller. The inner ends of the actuating levers disclosed in these patents are supported on parts located within the cabinet interior and the free ends extend through a slot in the cabinet which permits the cover to open and close without interference with the lever or drive mechanism. The structures illustrated in these patents also require relatively complex and expensive assemblies which are supported within the cabinet interior on the cabinet.

SUMMARY OF THE INVENTION

The invention provides a rack and gear drive for the feed roller in which a linear gear rack and integral gear actuating lever are provided to rotate the feed roll to dispense paper through the dispensing outlet. The lever and gear rack are integrally molded of plastic and are supported on the inside of the cabinet cover with a lever extending through a slot in the cover. When the cover is closed, the gear rack teeth are aligned to mesh with the teeth on an idler gear which drives the gear on the feed roller through a one-way clutch. This arrangement minimizes the complexity and expense of prior art drive mechanisms. There also are very few moving parts and maintenance is reduced to a minimum. Also, possibilities of damages to the drive mechanism by vandalism are reduced as compared with prior art devices. There are no long levers extending from the dispenser interior which can be bent or broken as with some prior art devices.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
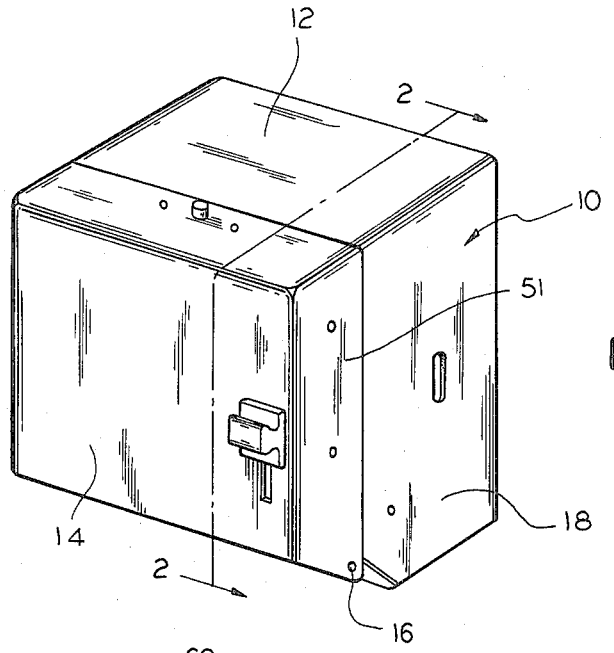
FIG. 1 is a perspective view of a roll towel dispenser embodying the invention.

In the drawings, FIG. 1 discloses a roll towel dispenser 10 having a cabinet or housing 12 with a housing or dispenser cover 14. The cover 14 is pivoted by pins or rivets 16 to the lower corners of the side walls 18 of the housing 12.

Figure 2:
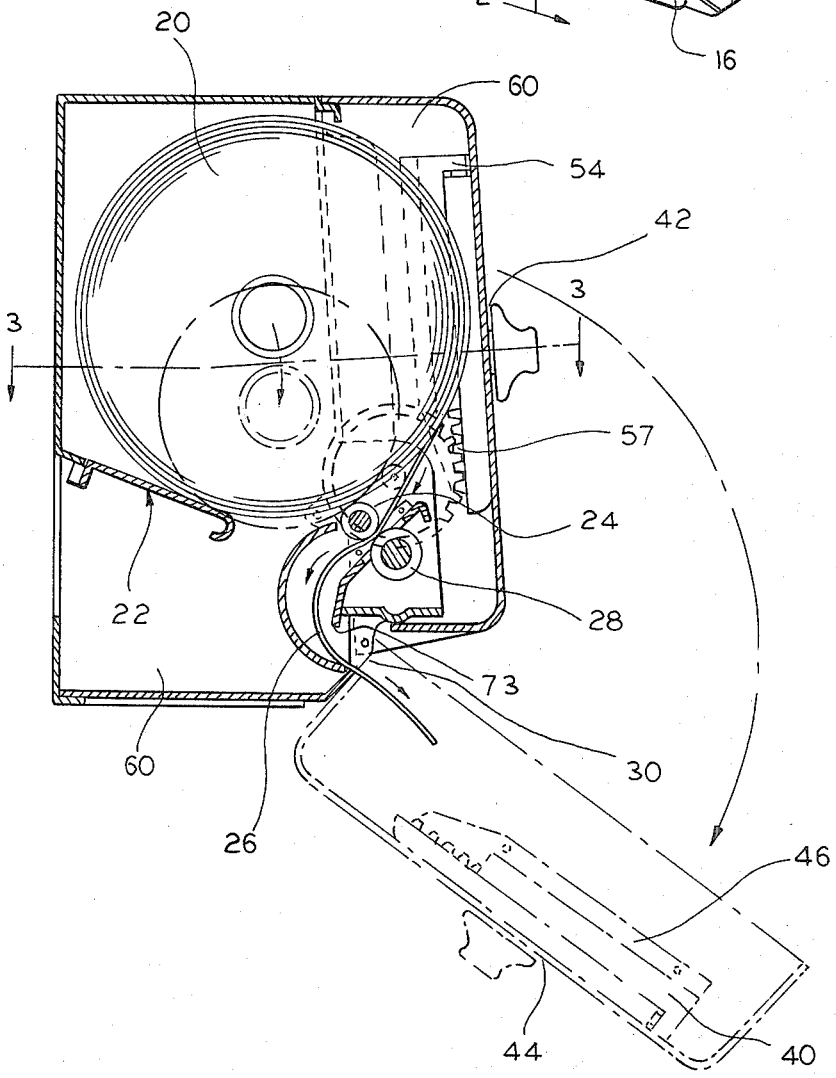
FIG. 2 is an enlarged fragmentary sectional view along line 2—2 of FIG. 1.
Figure 3:
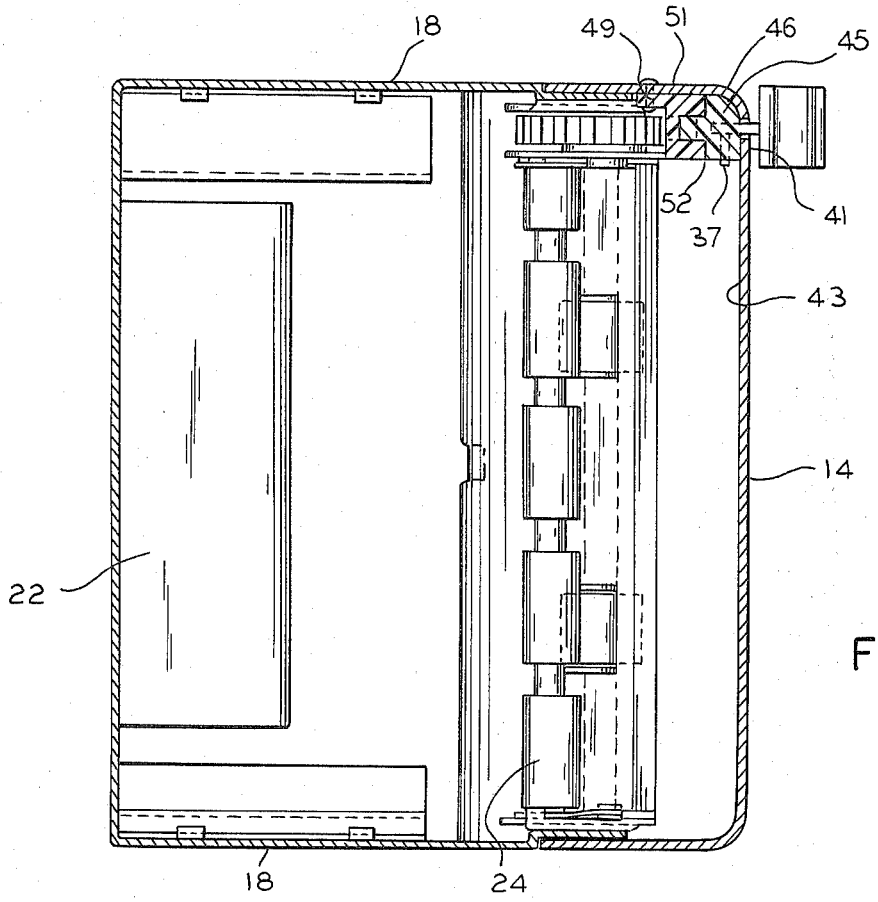
FIG. 3 is a view along line 3—3 of FIG. 2.
Figure 4:
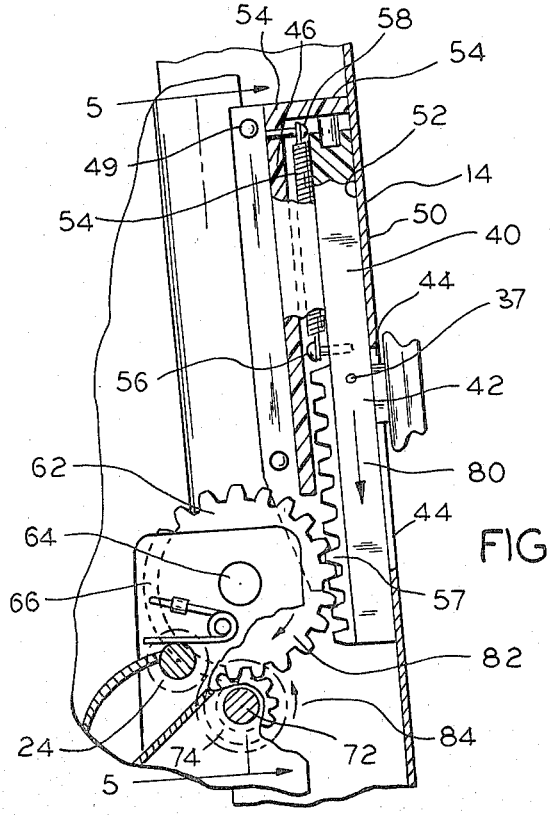
FIG. 4 is an enlarged view of the rack and gear dispensing mechanism shown in FIG. 2.
Figure 5:
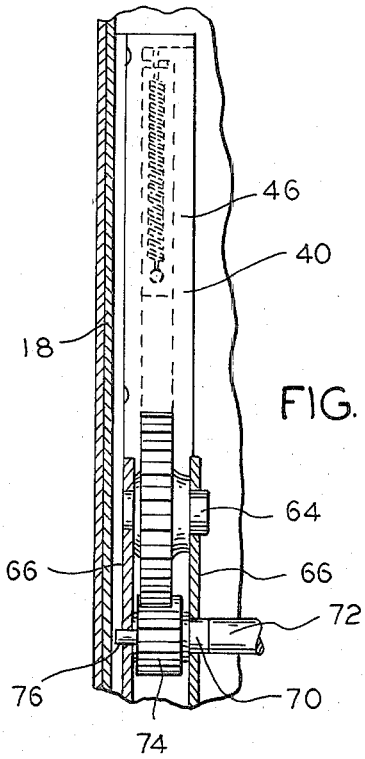
FIG. 5 is a view similar to FIG. 4 of the rack and gear mechanism looking outwardly from the cabinet interior.

A roll 20 of paper towelling is freely supported on a cradle formed by a shelf 22 and an idler roller 24 (FIG. 3). The end 26 from the roll 20 is threaded between the idler roller 24 and a feed roller 28 (FIG. 4). The end 26 extends through a dispensing outlet 30 (FIG. 2) at the bottom front of the dispenser. As thus far described, the arrangement and parts are conventional.

In accordance with the invention, drive means are provided to rotate the feed roller 28 to dispense the web. In the disclosed construction, the means includes a slide 40 (FIG. 2) having a knob or actuating lever 42 which projects through an opening 44 in the cover 14 of the dispenser for manipulative access by the user. As illustrated in FIG. 3, the slide 40 is positioned with a slide front surface 41 in sliding contact with the inside surface 43 of the cover 14. The slide also has a curved surface 45 which is complementary to and interfits with corner 47 of the cover 14. The slide 40 is also confined by a guide block 46 (FIGS. 2 and 4) which is spaced from the surface 43 of the cover to provide a space 52 which receives the slide 40. A mounting flange 49 on block 46 (FIG. 3) enables the block to be secured to the side 51 of the cover 14. The block also includes a top wall 54 which limits upward movement of the slide. The block 46 is desirably formed from plastic. The slide is spring-loaded to the rest position shown in FIG. 4 by a spring 54 which is connected by a pin 56 to the slide 40 and a pin 58 to the block.

The slide 40 is provided with a linear gear rack 57, with teeth projecting rearwardly from the cover toward the cabinet interior 60. The teeth 57 mesh with a gear 62 which is supported by a stub shaft 64 between a pair of spaced plates 66. The plates 66 also support the input shaft 76 of feed roller 28. Contained within the end of feed roller 28 is a one-way clutch 70, as illustrated and described in U.S. Pat. No. 3,843,218, the entire disclosure of which is incorporated herein by reference. A gear 74 supported on the input shaft 76 of the one-way clutch 70 meshes with the gear 62. The one-way clutch 70 extends into and is in a press fit in the tubular feed roller 28 and provides rotation of the feed roller 28 in one direction only.

The teeth 57 are coplanar with gear 62 so that the teeth 57 mesh when the cover 14 is closed. In operation of the dispenser, downward movement of the protruding knob or lever 42 in the direction of arrow 80 (FIG. 4) will cause movement of the gear 62 in the direction of arrow 82, which will rotate the gear 74 in the direction of arrow 84. One cycle will feed a predetermined amount of web through the dispensing outlet 30. As the slide returns to the upward position, as shown in FIG. 4, under influence of the spring 54, the one-way clutch allows rotation of the gear 62 and the gear 74 without any influence or driving connection to the feed roller 28. The lever 42 can be shifted downwardly a sufficient number of times to provide the desired length of web which typically is stripped from the dispenser when the web comes in contact with a serrated edge 73.

All the gears, including the gear rack, can be formed from plastic to provide quiet operation. The gear rack is desirably integrally molded with the slide.

The lever 42 can be a strip of metal which extends into a slot in the slide 40 and secured therein by a rivet 37. A plastic knob 35 can be secured to the lever 42.

We claim:

1. In a dispenser for dispensing a web from a roll of paper, said dispenser including a housing and a housing cover connected thereto to swing open and afford access to the housing interior and said housing including a dispensing outlet and means for supporting a paper roll within that housing and including a feed roller for withdrawing and dispensing a length of web from the roll, the improvement comprising drive means for rotating said feed roller, said drive means including actuator means, means for supporting said actuator means on said cover of said housing to afford reciprocating movement of said actuator means, with said actuator means having a part projecting forwardly thereof through an opening in the front of the cover for access, and first means on said actuator means cooperating with second means connected to said feed roller to cause rotation of said feed roller on actuation of said actuator means, said first and second means being in engagement when said cover is closed and said means disengaging to enable opening of said cover.

2. The improvement of claim 1 wherein said actuator means includes a projecting lever, a slide connected to said lever, said slide including a serial array of projecting teeth forming a linear gear, said teeth projecting rearwardly from said slide toward the interior of said housing, and guide means on the inside of said cover for guiding movement of said slide during reciprocating movement thereof, gear means supported within said housing and connected to said feed roller and said teeth being located in a plane coplanar with said gear means and meshing therewith when said cover is in a closed position to rotate said feed roller upon reciprocating movement of said actuating lever.

3. The improvement of claim 1 including one-way clutch means intermediate said gear means and said feed roller to afford rotation of said feed roller only on the down stroke of said actuator means.

4. The improvement of claim 1 wherein said slide comprises a generally rectangular block of plastic, with the teeth projecting from said block and said guide means has a shoulder abutting said block and a groove for receiving said teeth and providing clearance for said teeth, said guide means being secured to said cover.

5. The improvement of claim 2 wherein said linear gear is formed integrally with said slide.

6. The improvement of claim 2 including spring means supported on said cover and connected to said slide to urge said slide into a preselected position.

* * * * *